United States Patent [19]

Frear

[11] Patent Number: 4,472,013

[45] Date of Patent: Sep. 18, 1984

[54] ELECTRICAL CONNECTOR ASSEMBLY HAVING AN ANTI-DECOUPLING DEVICE

[75] Inventor: David L. Frear, Afton, N.Y.

[73] Assignee: The Bendix Corporation, Southfield, Mich.

[21] Appl. No.: 432,618

[22] Filed: Oct. 4, 1982

[51] Int. Cl.[3] ..... H01R 13/623

[52] U.S. Cl. ..... 339/89 R; 339/DIG. 2

[58] Field of Search ..... 285/82; 339/89 R, 89 C, 339/89 M, 90 R, 90 C, DIG. 2

[56] References Cited

U.S. PATENT DOCUMENTS 3,455,580 7/1969 Howard ..... 339/DIG. 2
4,235,498 11/1980 Snyder ..... 339/DIG. 2
4,290,662 9/1981 Storcel ..... 339/89 M

FOREIGN PATENT DOCUMENTS 1401373 7/1975 United Kingdom ..... 339/90 R

*Primary Examiner*—John McQuade
*Attorney, Agent, or Firm*—C. D. Lacina

[57] ABSTRACT

A coupling nut (300) constrains a lock ring (400) to be moved into biased abutment against forward facing flank (222) of external thread (220) on a receptacle shell (200) as a result of the coupling nut being rotated about a plug shell (100) to which it is mounted, the lock ring (400) including a plurality of deflectable leaf spring fingers (406) adapted to engage said forwardly facing flank (222), uncoupling being resisted by a cam section of forwardly facing flank (222) being required to deflect leaf spring finger (406) downwardly and overcoming oppositely biased friction between rearward facing flanks (224, 324) tightened by coupling nut (300) when at the full mate position.

11 Claims, 9 Drawing Figures

FIG. 1
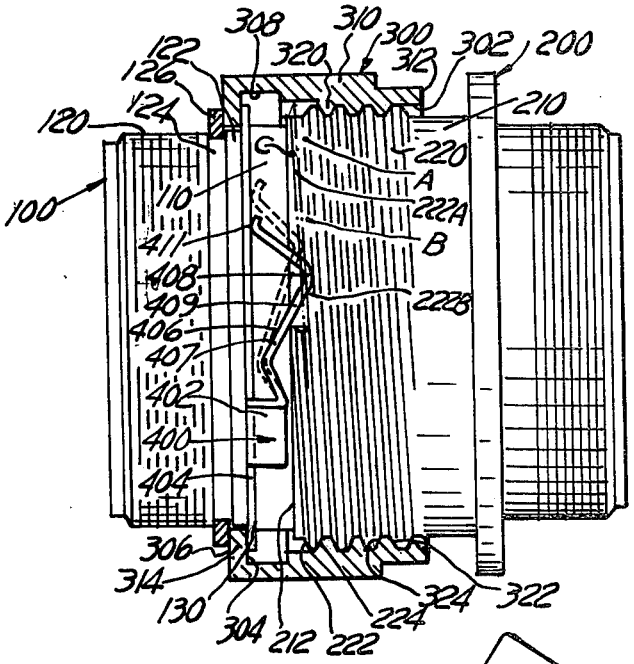
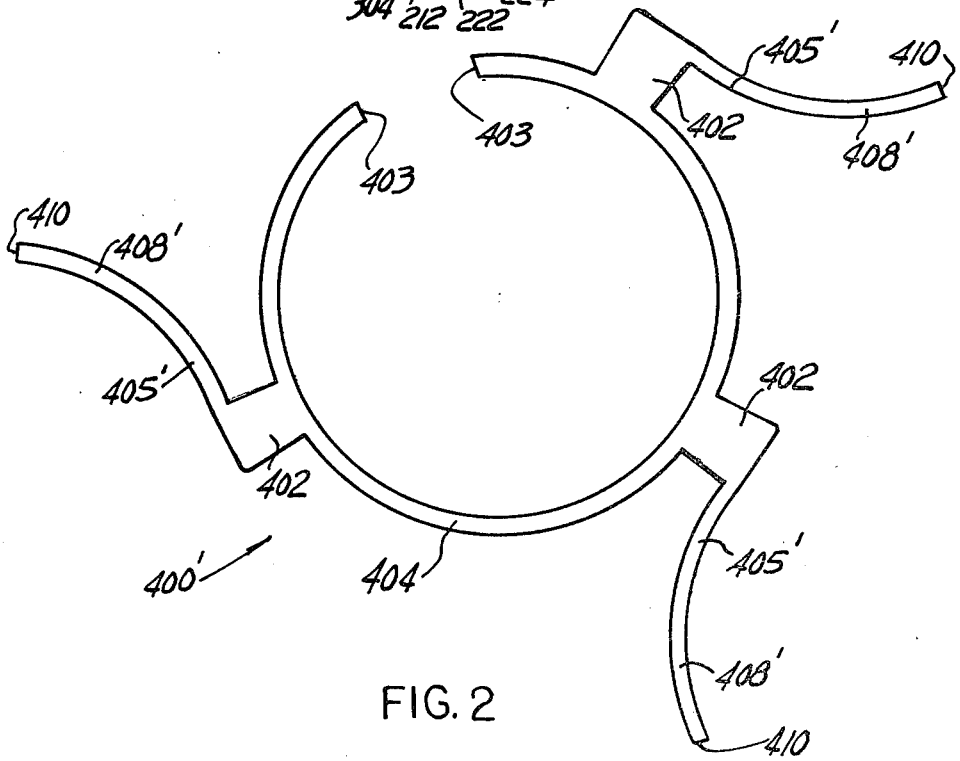
FIG. 2

FIG. 3
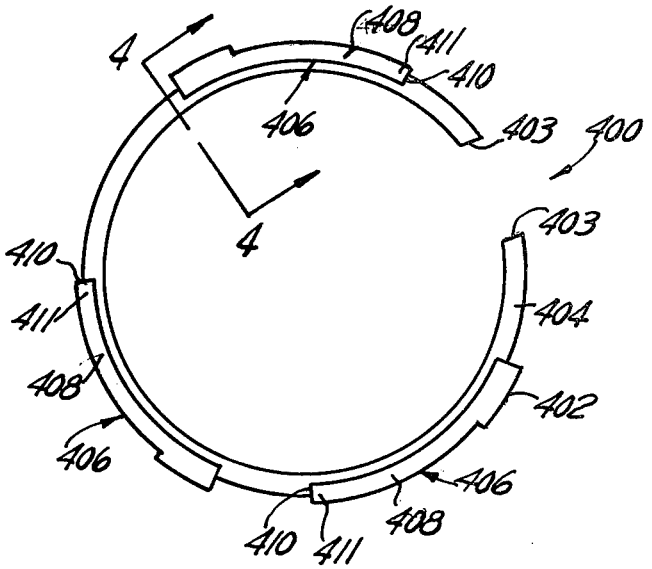
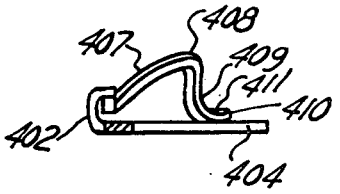
FIG. 4
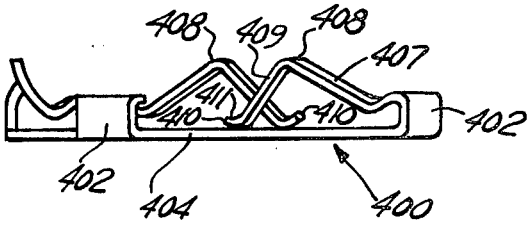
FIG.5
FIG.9
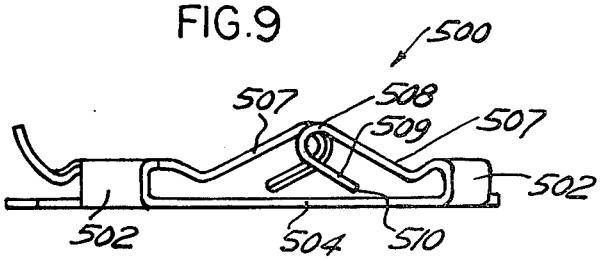

ELECTRICAL CONNECTOR ASSEMBLY HAVING AN ANTI-DECOUPLING DEVICE

This invention relates to an electrical connector assembly having an anti-decoupling device and more particularly to a coupling nut having a deflectable projection which engages advancing thread flanks of a mating connector and provides a rearward bias upon mating thread faces for resisting unwanted disconnection.

A typical electrical connector assembly comprises a plug member and a receptacle member with a set of pin contacts mounted in one member for mating with a set of socket contacts in the other member with a coupling nut rotatably mounted on the plug member and adapted for threaded engagement with the receptacle member, rotation of the coupling nut drawing the connector members and contacts together into a mated relation in an axial motion and without relative rotation. Reverse rotation of the coupling nut also enables disassembly of the members.

Without more, the coupling nut is retained in its advanced position by frictional engagement between the forward and rearward facing flanks of the mating threads. Once the coupling nut has axially drawn the assembly together and provided fully mated engagement the nature of the threaded engagement is such that only the rearward facing flanks are in engagement. Since the coupling nut must also allow disassembly it is not uncommon to find that the clearance provided between the mating threads will allow the coupling nut to loosen under vibrational influences.

In the use of such connectors there has been a need for making certain that the coupling nut does not back off under vibration or other forces. Vibration forces could allow axial "hammering" to exist between the connector members (i.e. force thread surfaces to disengage) and cause the coupling nut to "back off" from its connection. This would be even more so when the thread mating surfaces are lubricated to prevent galling and wear of the surfaces, the lubrication reducing frictional interengagement forces. There is a need for means to provide a better positive resistance to unwanted backoff of the coupling nut once the plug and receptacle connector members are fully mated.

Prior electrical connectors which utilize a coupling nut for drawing the connector members together and which have locking means for holding the coupling nut in place to prevent unwanted back-off are known. Typically, with these "locking means" the user will apply a coupling torque of an amount higher than an uncoupling force which would be experienced in the operation. An "Electrical Connector With Locking Means" U.S. Pat. No. 4,235,498 to Snyder issuing Nov. 25, 1980, a resilient detent element was disposed in a bayonet ramp groove of the coupling nut so as to be axially deflected and engaged by the corresponding bayonet pin driven thereover as a result of the coupling member being screwed therewith. To uncouple, the bayonet pin would have to successively be forced from detent-to-detent. In "Locking Device In A Bayonet Electrical Connector" U.S. Pat. No. 3,455,580 to Howard issuing July 15, 1969 a restraining spring disposed in a bayonet ramp captivated a bayonet pin at the fully mated condition for locking two connector members from uncoupling. Providing an electrical connector with locking means which utilizes existing coupling thread for resisting uncoupling by applying axial pressure thereagainst to enhance frictional resistance of the thread from back-off would be desirable.

A waved washer which biases a radial flange of the coupling nut against a shoulder of the connector member to which the nut is rotatably mounted is known. Preferably, pressure forces would be applied directly against the flank surfaces of the thread on the other connector member onto which the coupling nut engages, thereby biasing the threaded portion thereof into constant engagement.

In accord with this invention a lock ring is stamped from a sheet of metal and formed into an annular disk adapted to clearance fit about the plug shell and be mounted to the coupling nut, the lock ring having an outer rim with a plurality of neck portions extending transversely therefrom with each neck portion including a deflectable resilient leaf spring finger having a knuckle adapted to bear against forwardly facing flank formed by external helical thread disposed around the receptacle member and spiralling rearwardly from the front face thereof, the coupling nut being mounted to the plug shell for rotation thereabout and the lock ring being constrained to rotate with the coupling nut about the plug member, the knuckle being formed by the leaf spring finger being reversely bent to form a V-shape and the leaf spring finger having a distal end thereof disposed in abutment against the annular disk, initial uncoupling rotation of the coupling nut relative to the connector members being resisted by augmented frictional forces developed by the engaged threads. Due to a slant provided by the helical external thread on the receptacle member, should the receptacle member start to uncouple, the thread flanks will be cammed against the knuckle and further uncoupling could occur only upon deflecting the leaf spring rearwardly towards the annular disk.

One advantage of this invention is provision of a lock ring offering increased frictional resistance to uncoupling rotation and taking advantage of the inherent slant of mating threads having to cam a deflectable leaf spring to rotate in an uncoupling direction. Such an anti-decouping device prevents undue wear and provides increased force only to prevent decoupling.

One way of carrying out the invention is described below with reference to the drawings which illustrate one specific embodiment of this invention, in which:

FIG. 1 is an elevation view, partially in section, of an electrical connector assembly including a lock ring according to this invention.

FIG. 2 is a plan view metal stamping.

FIG. 3 is a plan view of the lock ring of FIG. 1 formed from the stamping of FIG. 2.

FIG. 4 is an elevation view, partially in section, of the lock ring taken along lines 4—4 of FIG. 3.

FIG. 5 is an elevation view of the lock ring of FIG. 3.

FIG. 9 is an elevation view of the lock ring of FIG. 7.

Figure 6:
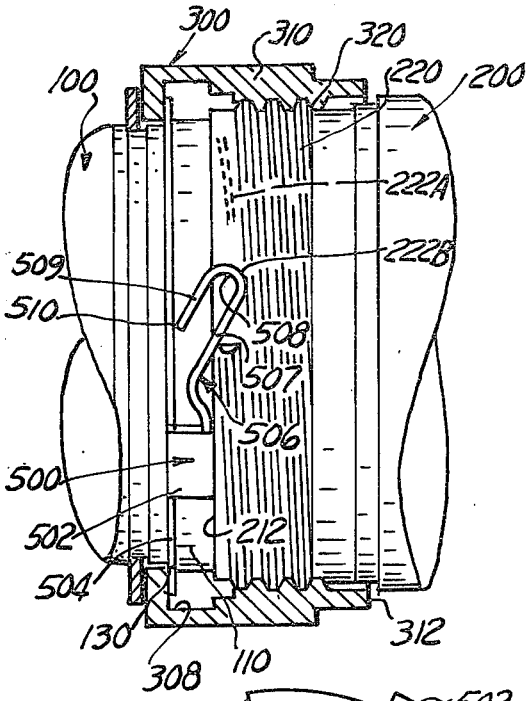
FIG. 6 is an elevation view, partially in section of an electrical connector assembly including an alternate lock ring embodiment formed from the blank shown in FIG. 2 and according to this invention.

Referring now to the drawings and FIG. 1 in particular, an electrical connector assembly according to the present invention includes coaxial first and second electrical connector members 100, 200 releasably coupled together by a coupling nut 300 and including an anti-decoupling device.

The first electrical connector 100, also considered a plug-type connector, comprises a cylindrical shell or front portion 110, a rear portion 120 and an annular shoulder 130 medially of the shell portions, rear portion 120 including a stepped groove 124 and an annular wall 122 circumjacent annular shoulder 130. The second electrical connector 200, also considered a receptacle-type connector, comprises a cylindrical shell or front portion 210 having an end face 212 and external thread 220 on the outside surface thereof, the forward portion 110 of the plug shell being sized to telescopically interfit within the forward portion 210 of the receptacle shell when the connectors are drawn together for mating. Although not shown, the respective plug and receptacle connectors 100, 200 include a dielectric insert therewithin for retaining one or more electrical contacts.

Coupling nut 300 is coaxially, rotatably mounted on the plug connector 100 and comprises a cylindrical coupling sleeve 310 and an inwardly extending radial flange 314, the coupling sleeve having an end face 312 and an inner wall 302 including internal thread 320 thereon, the inward radial flange 314 having inner and outer end walls 304, 306 and the internal thread 320 being adapted to connect with the external thread 220 on second shell 200 to axially draw the first and second shells 100, 200 together along a central axis with the contacts mated, the radial flange being captivated for rotation adjacent annular shoulder 130 by a retaining ring 126 received within stepped groove 124.

Preferably and in accord with this invention coupling nut 300 carries a lock ring 400 for biasing the connectors apart and resisting uncoupling rotation and inner wall 302 of coupling sleeve 310 is provided with an annular undercut 308 circumjacent inner end wall 304 of radial flange 314 for receiving a portion of lock ring 400, the lock ring being constrained to rotate with the coupling nut and having a forward portion adapted to bias against and be disposed in abutting relation with the forwardmost flank to external thread 220. Lock ring 400 is stamped and formed from metal into one piece and comprises a substantially flat annular disk 404 adapted to clearance fit plug shell 100 and abut inner end wall 304, a neck portion 402 extending transversely from the rim and forwardly therefrom and a resilient deflectable leaf spring finger 406 extending from neck portion 402 and including a medial knuckle 408, the neck portion 402 being adapted to fit within annular undercut 308 and the knuckle 408 being adapted to engage the external thread 220 for biasing the connectors 100, 200 in opposite axial directions.

Upon unwanted uncoupling rotation of receptacle shell 200, the external thread 220 advances a portion of its forwardly facing thread flank slightly forward (shown in phantom) as forward portion 210 recedes and end face 212 withdraws axially from the plug connector, causing a point "A" on the forwardmost thread 220 to spiral slightly rearward and another point "C" on the forwardmost thread 220 (shown on phantom lines) to spiral rearwardly and engage the knuckle 408 of the lock ring to deflect the spring finger, the spring finger bias against the thread resisting the uncoupling rotation and partially deflecting.

The helical external and internal thread 220, 320 have, respectively, forwardly and rearwardly facing flank 222, 322; 224, 324 spiralling longitudinally rearwardly relative to end faces 212, 312 of their respective shells 210, 310, the forward facing flank 222 of external thread 220 defining first and second flank sections 222A, 222B immediately adjacent end face 212 with second flank section 222B being spiraled further rearward end face 212 then first flank section 222A and first flank section 222A (shown in phantom) being cammed against the knuckle 408 as a result of slight uncoupling rotation of the receptacle, knuckle 408 being in abutment initially against second flank section 222B and then rotated into abutment against first flank section 222A during uncoupling, deflectable finger 406 initially biased and partially deflected by abutment with seond flank section 222B and ultimately against first flank section 222A, deflectable finger 406 thereby biasing the receptacle shell 200 and plug shell 100 in opposite axial directions and biasing rearward facing flanks 224, 324 together, uncoupling rotation being resisted by enhanced sliding friction between rearward flanks 224, 324 and by forward facing flank sections 222A, 222B having to successively cam knuckle 408 axially downward towards annular disk 404 to allow uncoupling rotation to proceed.

FIG. 2 shows a metal blank 400' stamped from a sheet of metal of generally uniform thickness from which lock ring 400 is formed. Metal blank 400' comprises a split ring having a plurality of projections extending therefrom, the split ring being generally C-shaped to define an annular disk 404 having separated end faces 403 and the projections including a neck portion 402 disposed around the rim and having a radially curved projection 405' extending outwardly from the neck, each radially curved projection 405' having a medial portion 408' and curving radially outward to a distal end 410.

FIGS. 3–5 show lock spring 400 according to the present invention formed from metal blank 400'. Each of the neck portions 402 are bent upwardly from the sheet so as to extend perpendicularly from the C-shaped annular disk 404 and each of the radial projections 405' are bent radially inwardly relative to the neck so as to be parallel with annular disk 404 whereby each radial projection 405' substantially registers with (i.e. superposes) the C-shaped split ring or annular disk 404. The medial portion 408 of each radial projection 405' is reversely bent upon itself so as to position respective distal ends 410 substantially in contacting abutment with annular disk 404. Reverse bending of the radial projections define a leaf spring finger 406 having knuckle 408 at the medial portion 408.

FIG. 3 shows lock ring 400 (in plan) formed from metal blank 400'. The neck portions 402 are bent so as to extend substantially perpendicularly from annular disk 404. The radial projections 405' are bent inward from the neck portions so as to be in register with annular disk 404 and form a deflectable, leaf spring type finger 406, the medial portions thereof being bent to form the knuckle 408. Spaced ends 403 allow the C-shaped lock ring 400 to be diametrically expansible for allowing tight fitment within annular undercut 308 of the coupling nut 300.

FIG. 4 shows a partial section view in elevation of lock ring 400 comprising the annular disk 404 having neck portion 402 extending perpendicularly from the rim and including radial projection 405' being reversely bent upon itself to form the leaf spring 406 having the knuckle 408.

FIG. 5 shows an elevation of lock ring 400 according to the present invention. The knuckle 408 is generally Vee-shaped and comprises first and second legs 407, 409 having their adjacent leg ends secured and forming a Vee-shape, the other end of first leg 407 being connected to neck portion 402 and the other end of second leg 409 being slightly curved to define at the distal end 410 a foot 411 for biasing against the top surface of annular disk 404, the bottom surface of annular disk 404 being adapted to abut the inner end wall 306 of the coupling nut flange.

FIG. 6 shows an electrical connector assembly similar to FIG. 1 with an alternate lock ring 500 according to the present invention. Lock ring 500, also formed from metal blank 400', comprises annular disk 504, a neck portion 502 extending transversely forward from the rim of annular disk 504 to include a deflectable finger 506 reversely bent upon itself, the distal end 510 of finger 506 being abutted against the annular disk 504 and defining a U-shaped knuckle 508 for biasing against forwardly facing flank 222A, 222B.

Figure 7:
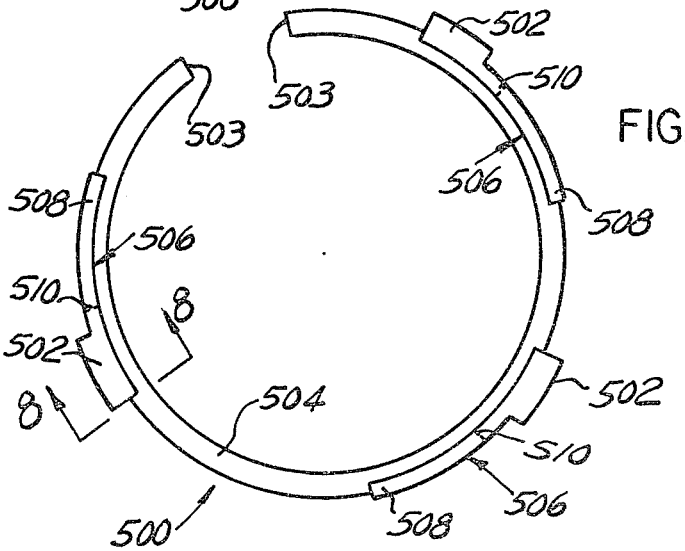
FIG. 7 is a plan view of the alternate lock ring of FIG. 6 formed from the blank of FIG. 2.
Figure 8:
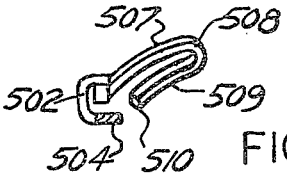
FIG. 8 shows an elevation view, partially in section, of the alternate lock ring taken along lines 8—8 of FIG. 7.

FIGS. 7–9 show alternate lock ring 500 formed from metal blank 400' of FIG. 2.

In FIG. 9, the knuckle 508 is generally U-shaped and comprises first and second legs 507, 509 having their adjacent leg ends secured and forming the U-shape, the other end of first leg 507 being connected to neck portion 502 and the other end of second leg 509 defining the distal end 510 for biasing against the top surface of annular disk 504.

In the use of the connector according to this invention, the plug 100 is oriented for mating with receptacle shell 200 and coupling nut 300 positioned so that its internal threads 320 engage with the external threads 220 on the receptacle shell 200. Although not shown, typically a key and a keyway on the connectors orient the connectors for mating without rotating. Either lock ring 400, 500 is disposed to have its annular disk 402, 502 secured to the coupling nut and constrained to rotate with the radial flange 314 and neck portions 402, 502 disposed within annular undercut 308 of coupling sleeve 310. The coupling nut is then rotated in a coupling direction whereby the plug and receptacle are axially drawn together without rotation. When the coupling nut reaches the end of the engagement between the threads and achieves substantially full mate, the knuckle 408, 508 of the respective resilient deflectable fingers 406, 506 are compressed downwardly toward the radial flange by forwardly facing flank 222 being advanced thereagainst. Preferably, the thread 220 would be "blunt" start in that its initiating end is cut-off to assist in orientation. Further, the thread 220 would be designed to be initiated at 120° separations and allow total engagement in less than a complete twist.

When coupling nut 300 is in its final mated position, the "blunt" start end of a first flank section 222A of external thread 220 will have been advanced beyond the knuckle 408, 508. That is, either the V-shaped or the U-shaped portion forming the reversely bent portion of the leaf finger 406, 506 will be biased against the second flank section 222B of external thread 220. The knuckles 408, 508 will press against the forwardly facing flank 222 and force the rearwardly disposed flanks 224, 324 into engagement to increase frictional resistance to uncoupling rotation. If vibration or other disconnecting forces should act upon the coupling nut to cause uncoupling rotation, forwardly facing first flank section 222A, closer to end face 212, will be driven against the knuckle with further rotation only being permitted if the knuckle is deflected downwardly. Although the description of this invention has been given with reference to a particular pair of spring locking embodiments, it is not to be construed in any limiting sense. Many variations and modifications may occur to those skilled in the art.

I claim:

1. An electrical connector assembly having an anti-decoupling mechanism comprising: first and second shells (100, 200) connected in end-to-end relation, the second shell (200) having a front face (212) and including external thread (220) spiralling rearwardly from the front face; a coupling nut (300) having an end face (312) and including internal thread (320) spiralling rearwardly from the end face (312), the coupling nut being rotatably captivated about the first shell (100) and adapted to threadingly engage the external thread (220) and pull the shells together upon rotation of the coupling nut in the coupling direction; and an anti-decoupling mechanism operative only near full-mate of the connector shells for resisting unwanted uncoupling rotation of the coupling nut, threading engagement of said external thread (220) with said internal thread (320) bringing their respective forward facing flanks (222, 322) and respective rearward facing flanks (224,324) into abutting relation with a cam section being formed by an angular portion of the forward facing flank (222) of said external thread (220) adjacent to said front face (212), said anti-decoupling mechanism characterized by:

a resiliently deflectable leaf spring finger (406) constrained to rotate with the coupling nut (300), said sring having a V-shaped knuckle (408) for engaging the cam section of said external thread when the shells are substantially connected, the leaf spring finger (406) resisting uncoupling first by the knuckle (408) biasing the coupling nut away from the second shell (200) to maintain contact between the engaged rearward facing flanks (224,324) and thereby augment thread frictional forces opposing uncoupling rotation and secondly by unwanted uncoupling rotation causing the cam section to axially advance towards the spring finger and compress the leaf spring finger before the end portion of said second shell axially retracts from the knuckle.

2. The electrical assembly as recited in claim 1, wherein said coupling nut (300) includes an inwardly extending radial flange (314) having an inner end wall (306) and a coupling sleeve (310) having an inner wall (302), characterized by said inner wall (302) including an annular undercut (308) circumjacent said radial flange (314); a lock ring (400) having an annular disk (404) abutted against said radial flange (314); and means (402) disposed in said annular undercut (308) for interconnecting the deflectable leaf spring finger (406) to the annular disk (404) in such manner that said spring finger (406) extends forwardly from the annular disk (404) and in closely circumposed relation to the inner wall (302).

3. The electrical connector assembly as recited in claim 1, characterized by a plurality of like leaf spring fingers (406) adapted to engage said forward facing flank (222).

4. The electrical connectors as recited in claim 2, characterized by said reversely bent portion having an end portion (410) contacting the annular disk (404) to resist flattening of the V-shaped knuckle (408).

5. An anti-decoupling mechanism for an electrical connector assembly of the type including first and second shells (100, 200) and a coupling nut (300) for connecting the shells together, the coupling nut being rotatably mounted to the first shell and including a sleeve (310) having a front end face (312) and helical internal thread (320), said second shell having a forward end face (212) and helical external thread (220) to threadingly engage the helical internal thread (320), each said helical thread (220, 320) having, respectively, forward and rearward facing flank (222, 322; 224, 324) spiralling longitudinally rearwardly relative to respective end faces (212, 312), a portion of the forward facing flank (222) of the external thread (220) immediately adjacent to forward end face (212) defining first and second flank sections (222A, 222B) with the second flank section (222B) being spiralled further rearward from the end face (212) than the first flank section (222A), said anti-decoupling mechanism being adapted to retard uncoupling rotation of the coupling nut and characterized by:

bias means (400) for biasing said coupling nut rearwardly from said second shell (200), said bias means being constrained to rotate with the coupling nut and including a resilient, longitudinally deflectable, leaf spring finger (406) projecting axially forward therefrom and including a knuckle (408), said knuckle being adpated to be rotated into abutment initially against the first flank section (222A) whereupon the finger is deflected and ultimately against the second flank section (222B) whereupon the finger is biased against the external thread (220), thereby biasing the first shell (100) and the coupling nut (300) in an opposite direction to said second shell (200) and biasing said rearward facing flanks (224, 324) together, uncoupling rotation of the coupling nut being resisted by enhanced friction between the rearward facing flanks (224, 324) and by the forward facing flank sections (22A, 222B) having to cam the knuckle (408) axially downwardly to allow uncoupling rotation.

6. The anti-decoupling mechanism as recited in claim 5, wherein coupling nut (300) includes a radial flange (314), characterized by said sleeve (310) including an annular undercut (308) disposed circumjacent said radial flange (314) and said bias means (400) including an annular disk (404) having a plurality of neck portions (402) extending transversely from its outer rim, each said neck portion (402) including a deflectable leaf spring finger (406), said annular disk (404) being mounted to radial flange (314) with each said neck portion (402) being disposed within the annular undercut (308).

7. The anti-decoupling mechanism as recited in claim 6, characterized by said deflectable fingers (406) including first and second legs (407, 409) interconnected at adjacent ends to form said knuckle (408), said first leg (407) having its other end extending from neck portion (402) and said second leg (409) having its other end contacting annular disk (404).

8. The anti-decoupling mechanism as recited in claim 5 characterized by said legs (407, 409) being disposed at an acute angle to form a V-shaped knuckle (408).

9. An electrical connector of the type including:

first and second connector members (100, 200);

a coupling nut (300) rotatably carried by the first of said connector members (100);

complementary interengaging first and second thread (220, 320) operating, respectively, between the second of said connector members (200) and said coupling nut, said second connector member having a front face (212) with said first thread (220) having a forwardly facing flank (222) spiralling rearwardly from said front face (212); and means (400, 500) disposed between said coupling nut (300) and said second connector member (200) for resisting unwanted rotation of the coupling nut (300) relative to said first connector member (100), said resisting means (400, 500) characterized by:

an annular disk (402, 502) constrained to rotate with said coupling nut (300); an axially deflectable leaf spring finger (406, 506) adapted to engage said forwardly facing flank (222); and means (402, 502) for interconnecting the leaf spring finger (406, 506) to the annular disk (402, 502), said leaf spring finger (406, 506) including at least a pair of interconnected legs (407, 507; 409, 509) and said interconnecting means (402, 502) being adapted to have said leaf finger (406, 506) superpose the annular disk.

10. In combination with an electrical connector assembly of the type having: a tubular first shell having around an outside portion thereof at least one first thread, said first thread having a starting end and spiralling rearwardly around said first shell more than once such that said first thread has its flanks facing axially forward and rearward; a tubular second shell configured for mating with said first shell; a coupling nut having around the inside portion thereof a second thread mated with said first thread; means for rotatably mounting said coupling nut to said second shell; and means for retarding rotation of said coupling nut, said retarding means including at least one elongated spring having a projection thereon, the improvement characterized by means for mounting said spring at one end thereof to said coupling nut so that the projection on said spring extends axially towards the first thread on said first shell, said projection being V-shaped and adapted to engage the forward facing flank immediately adjacent to said starting end and immediately adjacent to an angular portion of said first thread at the end of its first spiral, initial uncoupling rotation of said first shell helically advancing the angular portion of said first thread axially towards said second shell and against the projection to increase the pressure between said projection and said first thread and between the mated thread.

11. The connector assembly as recited in claim 10 wherein the angular portion defines a cam section for engaging the point of said V-shaped projection and deflecting the spring.

* * * * *